United States Patent [19]

Risdon

[11] 4,282,691

[45] Aug. 11, 1981

[54] WEEP HOLE DEVICE

[76] Inventor: David G. Risdon, 1871 Greenpine Dr., Cincinnati, Ohio 45231

[21] Appl. No.: 79,182

[22] Filed: Sep. 26, 1979

Related U.S. Application Data

[63] Continuation-in-part of Ser. No. 965,606, Dec. 1, 1978, abandoned.

[51] Int. Cl.[3] ..... E04B 1/70; E04B 1/72

[52] U.S. Cl. ..... 52/101; 52/303

[58] Field of Search ..... 52/302, 101, 305, 303, 52/310

[56] References Cited

U.S. PATENT DOCUMENTS

| | | | |
|---|---|---|---|
| 1,935,116 | 11/1933 | Friedberg | 52/305 |
| 1,976,166 | 10/1934 | Friedberg | 52/305 |
| 1,992,819 | 2/1935 | Friedberg | 52/305 |
| 2,002,810 | 5/1935 | Friedberg | 52/305 |
| 2,153,288 | 4/1939 | Walsh | 52/305 |
| 2,163,286 | 6/1939 | Munro | 52/305 |
| 2,782,464 | 2/1957 | Joppich | 52/303 |
| 3,429,084 | 2/1969 | Brewer | 52/303 |

*Primary Examiner*—John E. Murtagh

*Attorney, Agent, or Firm*—Wood, Herron & Evans

[57] ABSTRACT

A device for allowing the escape of water from residential or commercial wall constructions. The device is particularly suitable in brick veneer walls to permit the escape of water which would otherwise penetrate the brick, window, or other wall areas, and collect between an inner structural wall and the brick veneer. The device includes a tube having a water outlet and inlet with an elongated durable porous wick material which extends outwardly from the water inlet to absorb moisture whereby the water seeps from the wick end to the outlet end. The outlet end may also have a screen cap to prevent pests from entering. The extending member prevents debris from clogging the inlet and collects water by sorption for feeding to the entry port whereby the water is channeled through the wall to the exterior of the building. The device prevents severe damage to buildings which might otherwise occur because of water, weather, pests and the like.

5 Claims, 4 Drawing Figures

WEEP HOLE DEVICE

RELATED APPLICATION

This application is a continuation-in-part of application Ser. No. 965,606, filed Dec. 1, 1978, by David G. Risdon, now abandoned.

BACKGROUND OF THE INVENTION

Weep hole products are known for removing water from cavity wall or veneer constructions. While the devices which have been employed are relatively inexpensive considering the overall cost of construction, the absence of weep holes can cause water to accumulate in the interior wall construction with substantial damage resulting to the dwelling. In the past, one method of allowing the water to escape from the wall was to include an opening or hole to the outside at spacings along the base of the wall. Another solution was to include a rope-like material between the bricks at the base of the wall such that the water may escape along the channel created by the porous fibers of the rope. Such ropes gradually deteriorate and thereby form weep holes in the brick. These devices are disclosed in U.S. Pat. Nos. 1,935,116 and 1,976,166. Furthermore, tubes of plastic have also been employed to provide weep hole devices. Other devices are shown by U.S. Pat. Nos. 2,153,288 and 3,429,084.

A number of problems have been associated with the aforementioned devices including the fact that open holes offer routes of penetration for various pests into the interior structure which can then lead to deterioration and health hazards in the building structure itself. Furthermore, oftentimes the holes formed to permit the escape of water become clogged with either constructions material, mortar, dirt, and so forth, and become ineffective. For instance, in the construction of the veneer walls, cement will fall down and collect into the base of the wall between the interior wall and the inside of the brick veneer. When such occurs, the moisture that inevitably penetrates the brick construction at one location or another will not escape because the weep hole is effectively blocked by such cement or debris. It is therefore very important to permit the escape of water from the interior of buildings in order to prevent severe and permanent damage to the commercial or residential construction. However, the present devices do not offer a satisfactory solution from a number of standpoints.

SUMMARY OF THE INVENTION

This invention is directed to a weep hole device which is considered to be more dependable and attractive than the prior devices for weep hole construction. The device is very durable and effectively allows for the escape of water from cavity wall or veneer constructions. In addition, the device prevents the penetration of the interior construction by pests and the like. These advantages are accomplished by a device which is a very inexpensive and non-corrosive structure in its most preferred aspects. These and other advantages will be further understood by the more detailed description which follows.

The weep hole device according to this invention comprises a tube of sufficient length to traverse the cross-section of a wall or veneer construction. Within the tube is an elongated durable porous member, hereinafter sometimes called a wick. The wick extends from the interior of the tube outwardly to provide an outwardly extending wick from the water inlet end of the tube. With such a structure properly placed at the base of a cavity wall or veneer construction, with the outwardly extending wick extending into the interior of the wall construction between the brick and the inside wall, water is permitted to escape from the wall to prevent major defects from occurring and damage to the basic structure itself. The extending wick prevents debris from clogging the inlet end, but allows water to be collected and fed to the entry port of the tube for channeling to the exterior of the building. The term "durable" is employed to define a member which exists for a long time and retains its original qualities to function in the intended manner, i.e., to prevent debris from clogging the tube but to collect and feed water. The durable wick also keeps pests out. Further, in another embodiment, a porous cap end of the tube may be used to prevent pests from penetrating the interior structure and also to assist in the containment of the porous wick during manufacture and/or use.

In a most preferred form, the device is constructed from a plastic, preferably polyethylene, tube. Such tubes may be easily extruded, are readily available and fairly inexpensive. The porous member is preferably comprised of a durable fibrous plastic such as a polyester, thermoplastic fiber, nylon, or combinations of such materials which may be braided or formed in a number of different manners. The durable wick extends from the inside of the plastic tube along its substantial length out of one end. The outward extension of the wick allows for it to be placed up into the space between the inside of the brick veneer and the inner wall or flashing. This extending structure from one end of the tube accomplishes a number of functions. First, the extending wick prevents debris from clogging-up one end of the weep hole, thereby rendering it ineffective. In another important respect, the extending portion of the wick into the inner cavity allows for collection of the water that penetrates and may lay in the bottom of the cavity wall or construction. The collection of water occurs by osmosis or sorption and thereby such water is fed to the entry port of the weep hole device. Furthermore, when mortar or debris otherwise fills the bottom of the wall cavity, the weep hole device nevertheless is not rendered ineffective because it will absorb and transfer by osmosis and/or absorption to the opening of the weep hole tube whereby it then may be channeled through the wall to the exterior of the building. At the outlet end, a porous cap may be provided to keep larger pests out. The cap may be formed by a stainless steel screen. Such a stainless steel screen may be of suitable mesh size which will vary depending upon the construction, whereby water is permitted to escape and pests are prevented from penetrating the interior wall. Stainless steel also is rust resistant and lends to the life of the weep hole device.

In another of its preferred embodiments, an enlongated porous member will be placed within the tube such that a free channel is permitted for the water to controllably and rapidly be removed from the interior wall construction. In the device just discussed wherein the durable wick is placed within the confines of a plastic tube, the outer diameter of the wick is slightly smaller than the inner diameter of the tube such that a free continuous channel is formed by the wick and inner tube construction. Thus, the water is permitted to be transported to the entry port of the weep hole device and through the device from the interior of the wall to the exterior construction. In one preferred device, therefore, the overall construction of the plastic tube, durable wick and stainless steel screen cap, provides a very durable but relatively inexpensive device. Such a device also accomplishes the effective removal of water from the interior of the wall while preventing the penetration by pests. It also serves to prevent heat loss or gain through the wall. In these days of energy conservation, this is an important feature. Additionally, with the free channel within the tube between the elongated porous member and the inner diameter of the tube, a heavy water flow is permitted. The tube itself, of course, can vary in size, typically for instance between about 4 to about 6 inches having an inner diameter of approximately ¼ to ½ inch. Similarly, the wick may vary in size. These sizes are merely typical, depending upon various types of construction, and wherein varying rates of water flow may be anticipated.

Another feature of this invention is the unique method of making a weep hole device. This method comprises the manufacture of a plastic tube having a porous end cap. According to this method, an end of a plastic tube is melted or otherwise slightly softened and screen is brought into contact with the softened end whereby, upon cooling, the screen is firmly secured to and embedded into the end of the plastic tube. As mentioned above, the end cap performs a useful function of also retaining the nylon wick upon its location during the manufacture or use of the weep hole device. In a preferred form of the method, the stainless steel end screen may be formed into a shape of a small cup or flat screen and placed on or adjacent to a heating device whereby the plastic tube may simply be brought into contact with the heated stainless steel for softening and securing of the stainless steel end cap. Thereafter, the durable wick may be inserted in the tube for completion of the device.

The invention will be further understood with reference to the drawing in which.

Figure 1:
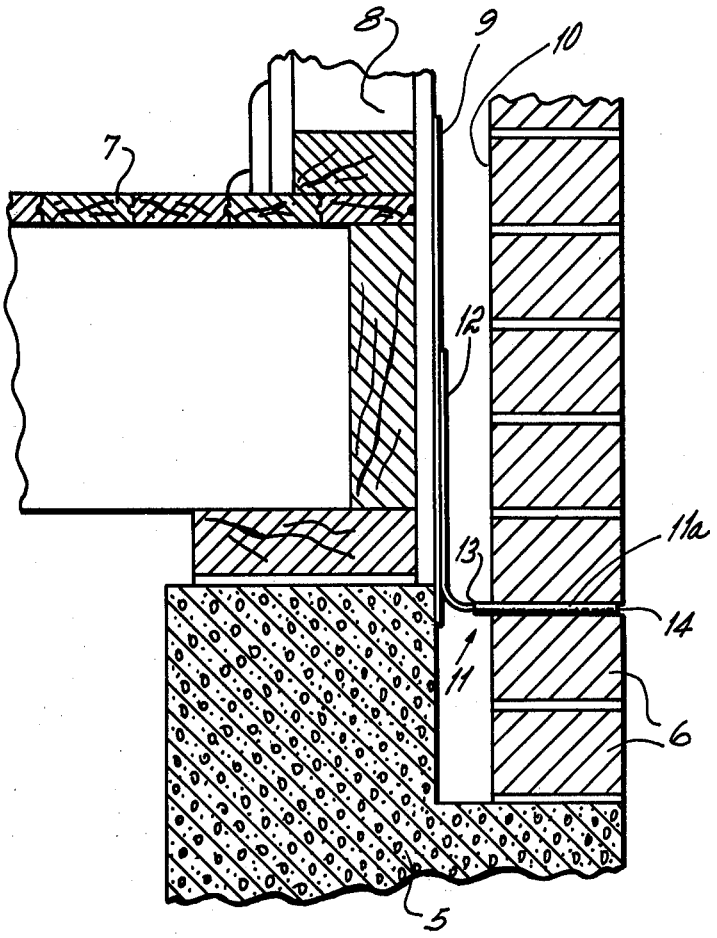
FIG. 1 is a cross-section through the base of a typical residential wall construction with brick veneer illustrating the weep hole device of this invention.

In FIG. 1, the mortar wall 5 has a shelf which supports the brick construction 6 shown generally in elevation. The interior wooden floor 7 construction is generally shown in partial cross-section with the interior wall 8 also having a flashing 9 exposed to the interior or gap between the inner brick facing 10 and interior wall 8. Located in a hole provided in the brick veneer is a weep hole device 11 according to this invention. As shown more particularly by FIGS. 2 and 3, the weep hole device comprises a tube 11*a*, preferably of polyethylene, having a braided nylon or polyester durable wick 12 inserted into the confines along substantially its entire length and extending outwardly to provide for sorption, and to convey it to the entry port 13 of the tube on the inside of the brick veneer. As stated above, such durable plastic fibrous materials may be used or employed with other materials. At the opposite end 14, more preferably shown by FIG. 3, the plastic is formed into a stainless steel screen 15. As explained above, the screen is formed by softening the plastic while it is in contact with the screen so that the end of the plastic tube will be molded or otherwise adhered to the screen. The mesh size of the screen, as also stated above, may vary depending upon the particular needs and location of the weep hole devices. As also will be observed by reference to FIG. 1, in the space between the inner wall and the inner brick veneer, in the event that mortar collects or other debris is deposited in the cavity, the wick extending from the opening of the weep hole device will preclude such debris from clogging the inner end of the tube and yet by osmosis, convection or otherwise, the moisture will still be conveyed to the entry port of the tube for drainage to the exterior of the building.

Figure 2:
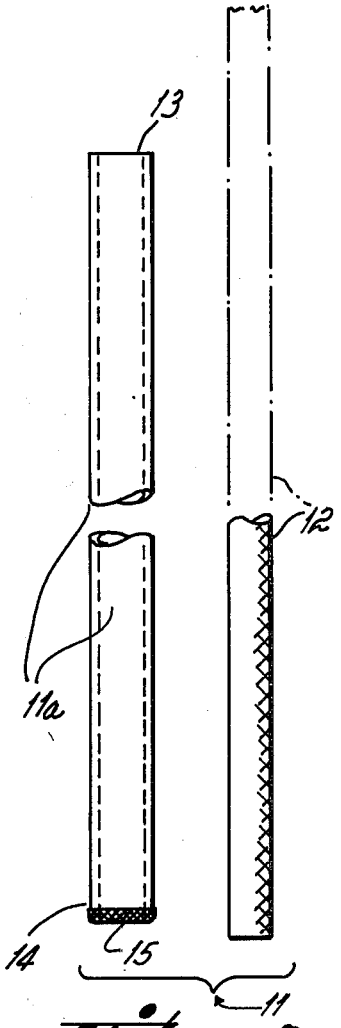
FIG. 2 is an enlargement of the weep hole device shown in FIG. 1, the components being disassembled.
Figure 3:
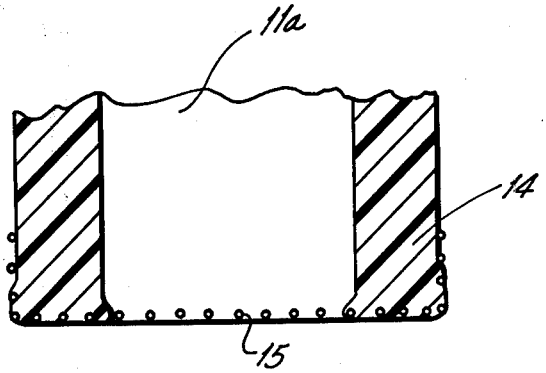
FIG. 3 is a cross-sectional further enlargement of the end of the device shown in FIG. 2.
Figure 4:
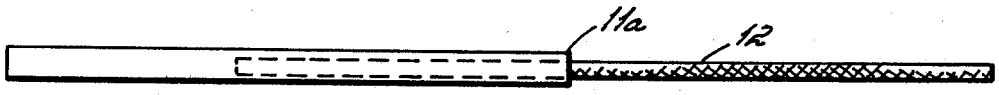
FIG. 4 is another form of the invention.

In FIG. 4, another device is shown where the end cap is eliminated and the device simply comprises the durable porous member or wick having the essential functions above described in connection with FIGS. 1–2. In the device of FIG. 4, the wick may be loosely held in the tube or secured therein so that it may be placed in position to function in the intended manner. A method of securing the wick in the tube includes adhesive attraction, for instance, pressure sensitive glues, taping means or the like.

While the above description has been particularly directed to a brick veneer type construction, it will be appreciated that other cavity, commercial or residential constructions may also be adapted to employ the weep hole device according to the principles of this invention. Furthermore, the location of the weep holes may vary from one type of structure to another as will be understood to those of ordinary skill in this art.

I claim:

1. A weep hole device for a building comprising a plastic tube having a water inlet end and a water outlet end, a stainless steel screen molded to the outlet end to provide a porous opening, and an elongated durable porous member extending from the interior of the tube and outwardly from the water inlet end, said extending member preventing debris from clogging said inlet end and collecting water by sorption for feeding to the inlet end whereby the water may be channeled through the wall to the exterior of the building.

2. The device of claim 1 wherein the tube is continuous and the porous member extends substantially into the interior of the tube.

3. The device of claim 2 wherein the dimensions of the inner diameter of the tube and the external diameter of the wick are such that a free channel is provided therebetween along the interior of the tube.

4. The device of claim 1 wherein said member comprises an elongated durable fibrous plastic material.

5. A weep hole device for a building comprising a plastic tube having a water inlet end and a water outlet end, a stainless steel screen molded to the outlet end to provide a porous opening, and an elongated wick comprising a durable fibrous plastic extending from the interior of the tube and outwardly from the water inlet end, said extending wick preventing debris from clogging said inlet end and collecting water by sorption for feeding to the inlet end whereby the water may be channeled through the wall to the exterior of the building, wherein the dimensions of the inner diameter of the tube and the external diameter of the wick are such that a free channel is provided therebetween along the interior of the tube.

* * * * *